US012669038B2

(12) United States Patent
Guo

(10) Patent No.: US 12,669,038 B2
(45) Date of Patent: Jun. 30, 2026

(54) METHOD FOR PRODUCING NATURAL GAS FROM GAS HYDRATES

(71) Applicant: UNIVERSITY OF LOUISIANA LAFAYETTE, Lafayette, LA (US)

(72) Inventor: Boyun Guo, Lafayette, LA (US)

(73) Assignee: UNIVERSITY OF LOUISIANA AT LAFAYETTE, Lafayette, LA (US)

( * ) Notice: Subject to any disclaimer, the term of this patent is extended or adjusted under 35 U.S.C. 154(b) by 0 days.

(21) Appl. No.: 18/734,120

(22) Filed: Jun. 5, 2024

(65) Prior Publication Data

US 2024/0410258 A1 Dec. 12, 2024

Related U.S. Application Data

(60) Provisional application No. 63/471,623, filed on Jun. 7, 2023.

(51) Int. Cl.
*E21B 41/00* (2006.01)
*E21B 34/02* (2006.01)
*E21B 43/24* (2006.01)

(52) U.S. Cl.
CPC ..... *E21B 41/0099* (2020.05); *E21B 34/025* (2020.05); *E21B 41/0064* (2013.01); *E21B 43/24* (2013.01)

(58) Field of Classification Search
CPC .. E21B 41/009; E21B 34/025; E21B 41/0064; E21B 43/24
See application file for complete search history.

(56) References Cited

U.S. PATENT DOCUMENTS

| | | | | |
|---|---|---|---|---|
| 6,684,956 | B1 * | 2/2004 | Berry | E21B 43/14 166/313 |
| 2007/0114026 | A1 * | 5/2007 | La Rovere | E21B 43/2401 166/57 |
| 2017/0089187 | A1 * | 3/2017 | Hytken | E21B 43/2406 |
| 2017/0137704 | A1 * | 5/2017 | Mazyar | E21B 43/24 |
| 2018/0238157 | A1 * | 8/2018 | Fu | E21B 43/2607 |
| 2019/0195053 | A1 * | 6/2019 | Foret | H05H 1/48 |

* cited by examiner

*Primary Examiner* — Silvana C Runyan
(74) *Attorney, Agent, or Firm* — Ted M. Anthony; Sarah B. Dupont

(57) ABSTRACT

A method for producing natural gas from subterranean gas hydrate deposits. A first injection wellbore includes a lateral section that extends into a subterranean geothermal zone. A second production wellbore includes a lateral section that extends into a subterranean gas hydrate zone. Water pumped into the first injection wellbore is heated by heat energy from the subterranean geothermal zone and is thereafter injected into the subterranean gas hydrate zone. The heated water injected into the subterranean gas hydrate zone is used to generate natural gas from gas hydrate deposits. The generated natural gas and injected water are recovered from the subterranean gas hydrate zone through the second production wellbore.

1 Claim, 4 Drawing Sheets

METHOD FOR PRODUCING NATURAL GAS FROM GAS HYDRATES

CROSS-REFERENCE TO RELATED APPLICATIONS

This application claims the benefit of U.S. Provisional Patent Application No. 63/471,623, filed Jun. 6, 2023, which is incorporated by reference herein in its entirety.

BACKGROUND

Field

Systems and methods for producing natural gas from gas hydrate deposits using natural geothermal water-flooding are described. In some embodiments, the systems and methods can provide for carbon dioxide ($CO_2$) sequestration.

Description of Related Art

Gas hydrates are solid crystalline compounds in which the gas molecules (guests) occupy the lattices of ice-like crystal structures called hosts (Byk and Fomina, 1968; Moridis et al., 2008). The hydrate form of gas is formed under low temperature and high pressure necessary for their formation and stability, which accounts for the common appearances of gas hydrates in the permafrost and deep offshore sediments (Kvenvolden, 1988). Despite the lack of a systematic assessment of gas hydrates and a large variance in its reserve estimation ($10^{15}$ to 1018 $m^3$ at standard conditions), it is generally acknowledged that the global reserve of this energy source is tremendous (USGS, 2001; Milkov, 2004; Klauda and Sandler, 2005). With its immense abundance, the ever-increasing demand for clean energy, and the limited amount of traditional fossil fuels, gas hydrates are gradually becoming a fundamental part of the energy sector for a growing number of countries worldwide (Demirbas 2010a, 2010b). Gas hydrate is favored even more with its ecologically friendly nature compared to that of traditional liquid fossil fuels. The global initiative to build a net-zero carbon community has added to the momentum of efforts to seek an alternative energy form. All these have accounted for the increasing attractiveness of gas hydrates to be a promising energy source for the decades to come, which clearly demands a full array of technical and economic evaluation (Abdalla and Abdullatef, 2005; Moridis et al., 2008).

There are many challenges presented when developing of gas hydrates. For example, it can be challenging to directly extract the gas in its original hydrate form since the hydrates will dissociate into gas and water when the surrounding P-T changes out of its stability zone (Dickens and Quinby, 1994). Therefore, a common method of production is to induce in-situ gas dissociation and collect the gas on the surface. The three main methods to induce hydrate dissociation are depressurization, thermal stimulation, and the use of inhibitors. Depressurization lowers the pressure in the hydrate zone below the hydration pressure at the in-situ temperature. This is currently the most common method to induce hydrate dissociation. Thermal stimulation raises the prevailing temperature of the hydrate zone above the hydration temperature by circulating hot water from the surface. Besides hot water, heat can also be introduced by heating underground pipelines using electricity. Inhibitors such as salts and alcohols can shift the P-T equilibrium by competing with the hydrate for guest and host molecules (Makagon, 1997). These methods are suitable for different types of gas hydrate reservoirs, and the combination of these methods is usually used to facilitate long-term gas production (Moridis and Reagan, 2007a,b; Moridis and Collett, 2004).

The depressurization-based method is commonly used due to their simplicity, technical effectiveness, and lower cost. But, because of the strong endothermic effect caused by the dissociation reaction and Joule-Thompson cooling effect due to the rapidity of dissociation under depressurization, the hydrate zone can experience steep local temperature drop and zone-wide temperature decline as hydrate dissociation takes place (Moridis et al., 2008; Shoghl et al., 2019; Gaydukova et al., 2021). The steep local temperature drop can result in the formation of solid phases such as secondary hydrate and ice in the vicinity of the producing well, which undermines well productivity and can even choke the well (Kurihara et al., 2005). The zone-wide temperature decline can adversely affect the long-term productivity of the well as the in-situ temperature continues to decrease. Thus, the depressurization-based method of production usually requires a uniform and slow change of the pressure and temperature gradients to maintain long-term production (Moridis et al., 2007a; Qin et al., 2020). Further, the attractiveness of depressurization is also challenged by permeability limitations for some low permeability hydrate formations. Hong and Pooladi-Darvish (2005) analyzed the sensitivity of the continuously declining production to various properties and operational conditions. They reported that the hydrate zone experienced a continuous and significant decline in temperature because of reservoir cooling caused by the endothermic dissociation. One of the most important observations from this study is that heat transfer was the dominant mechanism that controlled the hydrate dissociation process. Moridis et al. (2005) experimented with gas production by circulating warm water in a 17-meter-thick of gas hydrate zone and obtained a continuous gas production rate that peaked at 1,500 $m^3$/day. Their results confirmed that the replenish of heat into active producing gas hydrate formations can facilitate a longer production life span for the gas hydrate-bearing zone.

The thermal stimulation method essentially involves the manipulation of the P-T status of the gas hydrates for hydrate dissociation. The thermal stimulation method provides certain forms of heat transfer, the energy of which is usually provided by warm water or electricity from the surface, but hydrate dissociation that solely relies on conventional thermal stimulation (circulation of warm water and heating by electricity) cannot serve as a sustainable dissociation method because it is slow, inefficient, and excessively energy demanding. Heat transfer by warm water injection could also have adverse effects on the relative permeability of the hydrate formations. Electric heating is also significantly slower and less efficient. This process, however, is faced with many challenges such as the lack of information on the mechanical and hydraulic properties of hydrate-bearing zones, hydrate behavior under various production schemes, and the technical limitation of gas extraction only through endothermic reactions as in contrast to simple liquid production for traditional fossil fuels (Moridis et al., 2008). Furthermore, hydrate extraction is encountered with increasing technical complexity and operational difficulty at permafrost zones such as the Arctic, where major gas hydrate zones reside (Reagan et al., 2011).

The use of inhibitors can be challenging due to their short-term effectiveness, high cost, and risks of halite precipitation associated with the use of salt inhibitors. In the efforts to improve hydrate stimulation, some scholars have proposed novel well configurations to increase the efficiency of heat transfer, but these techniques still require tremendous commercial energy supply, and the aforementioned issues, therefore, persist (Moridis et al., 2008).

Furthermore, gas hydrate reservoirs can provide large spaces for storing $CO_2$ safely in low-temperature environments. Gas hydrates are ice-like compounds of water and small-molecule gases form at high pressure and low-to-medium temperature. Natural gas hydrates in permafrost zones and oceanic deposits represent a huge amount of methane which could supply the entire world economy for centuries (Allison, 2008).

Several methods have been tested for production of natural gas from marine gas hydrate reservoirs, including depressurization, thermal stimulation, and inhibitor injection. Apart from the economical point of view, it has not yet been proven that these methods are long-term safe. The risk is from the fact that, during production of natural gas from natural gas hydrate reservoirs, the solid hydrate structure will dissociate, and huge amount of water will be discharged with the produced gas. This should affect the geo-mechanical stability of formation and cause land-collapse and landslides (Kvamme et al., 2009).

It is challenging to directly extract the gas from the original hydrate form as the hydrate dissociation occurs and its surrounding pressure and temperature change out of the stability zone (Dickens et al., 1994). Wang et al. reported their result of analytic modeling and large-scale experimental study of mass and heat transfer during hydrate dissociation with different dissociation methods (Wang et al., 2016). They discovered the synergistic effect of depressurization and heat stimulation. The contribution of the heat stimulation to the hydrate dissociation is larger than that of the depressurization. Wang et al. performed experimental and modeling analyses of scaling criteria for methane hydrate dissociation by depressurization. They concluded that the gas production rate in the depressurization stage of field scale hydrate reservoir is considerable but is too low to satisfy the commercial production level. Wang et al. shows the temperature distributions during the hydrate dissociation process for the hydrate dissociation experiments within the reactors of the Pilot-scale Hydrate Simulator (PHS), the Cubic Hydrate Simulator (CHS), and the Small Cubic Hydrate Simulator (SCHS). According to this research, in the depressurization stages, the temperatures in all the simulators decrease from the initial reservoir temperatures (8.5° C.) to the hydrate equilibrium temperature (5.2° C.) due to the sensible heat consumption for hydrate dissociation. This temperature drop should depress hydrate dissociation and thus reduce gas production rate. Wang et al. revealed fluid flow mechanisms and heat transfer characteristics of gas recovery from gas-saturated and water-saturated hydrate reservoirs. They concluded that the thermal-assisted depressurization is the optimum method for producing gas from water-saturated hydrate reservoirs. However, thermal stimulation is costly due to the heat generation from artificial systems.

The existing method for storing $CO_2$ in underground is to inject $CO_2$ into depleted oil/gas reservoirs or virgin aquifers. The $CO_2$ is trapped there in form of super-critical fluid under high pressure. This method is simple but is problematic in the long run. Recent studies show that the $CO_2$-exposed wells in $CO_2$ sequestration projects have high probabilities of leaking after certain years of service due to the $CO_2$ attack to defective wellbore cement sheath (Duguid et al., 2017; Guo, B. 2017). It is just a matter of time, sooner or later, when the stored high-pressure $CO_2$ will leak to the atmosphere through aged wellbores or leaky formation faults.

Furthermore, the issue of global warming and climate change from using traditional hydrocarbons of high-carbon numbers has generated a great interest in harvesting natural gas from gas hydrate reservoirs by $CO_2$ sequestration. Methane and $CO_2$ both form type I hydrates (Sloan et al., 2008) and $CO_2$ is preferentially trapped over methane in the hydrate phase (Ohgaki et al., 1996). The methane-hydrate dissociation pressure is much higher than the $CO_2$-hydrate formation pressure at any given temperature, or the methane-hydrae dissociation temperature is lower than the $CO_2$-hydrate formation temperature at any given pressure (Sloan et al., 2008). According to Goel, the heat of dissociation of methane hydrate is less than the heat of formation of $CO_2$-hydrate (Goel, N. 2006). This means that the heat released from the formation of $CO_2$-hydrate should be sufficient to dissociate the methane hydrate. These facts support the idea of $CO_2$ sequestration in methane-hydrate reservoirs based on the concept of hydrate guest molecule exchange between methane and $CO_2$ in the hydrate phase.

A number of researchers have investigated this subject in the past two decades. Ohgaki et al. first presented their research result of methane exploitation by carbon dioxide from gas hydrates. Nago and Nieto presented a state-of-the-art review and technical approaches prior to year 2011. Zheng et al. provided a review of recent research and development. To mention a few, Kvamme et al. investigated the storage of $CO_2$ in natural gas hydrate reservoirs and the effect of hydrate as an extra sealing in cold aquifers. Graue et al. showed MRI visualization of spontaneous methane production from hydrates in sandstone core plugs when exposed to $CO_2$. Ersland et al. studies the transport and storage of $CO_2$ in natural gas hydrate reservoirs. Kvamme et al. investigated hydrate phase transition kinetics from phase field theory with implicit hydrodynamics and heat transport. Koh et al. analyzed natural gas hydrate production using gas exchange. Qorbania et al. performed computer simulation of $CO_2$ storage into methane hydrate reservoirs under non-equilibrium thermodynamic condition. They revealed that the solid state gas-exchange mechanism is a very slow process in which the heat released through formation of new $CO_2$ hydrate is the primary cause for dissociation of the in situ methane hydrate. Jadhawar et al. performed experimental investigations of $CO_2$ sequestration and storage in methane hydrate reservoirs combined with clean methane production. Promising results were obtained under varying thermodynamic conditions. But these thermodynamic conditions may not always exist in real gas hydrate reservoirs.

No successful case of $CO_2$ sequestration in gas hydrate reservoirs has been reported to date. The reason is attributed to the nature of very slow process of solid state gas-exchange mechanism, i.e., the heat released through formation of new $CO_2$ hydrate is not transferred fast enough to cause the fast dissociation of the in situ methane hydrate.

It is challenging to directly extract the gas from the original hydrate form as the hydrate dissociation occurs and its surrounding pressure and temperature change out of the stability zone (Dickens et al., 1994). Wang et al. reported their result of analytic modeling and large-scale experimental study of mass and heat transfer during hydrate dissociation with different dissociation methods. They discovered the synergistic effect of depressurization and heat stimulation. The contribution of the heat stimulation to the hydrate dissociation is larger than that of the depressurization. Wang et al. performed experimental and modeling analyses of scaling criteria for methane hydrate dissociation by depressurization. They concluded that the gas production rate in the depressurization stage of field scale hydrate reservoir is considerable but is too low to satisfy the commercial production level. Wang et al. shows the temperature distributions during the hydrate dissociation process for the hydrate dissociation experiments within the reactors of the Pilot-scale Hydrate Simulator (PHS), the Cubic Hydrate Simulator (CHS), and the Small Cubic Hydrate Simulator (SCHS). According to this research, in the depressurization stages, the temperatures in all the simulators decrease from the initial reservoir temperatures (8.5° C.) to the hydrate equilibrium temperature (5.2° C.) due to the sensible heat consumption for hydrate dissociation. This temperature drop should depress hydrate dissociation and thus reduce gas production rate. Wang et al. revealed fluid flow mechanisms and heat transfer characteristics of gas recovery from gas-saturated and water-saturated hydrate reservoirs. They concluded that the thermal-assisted depressurization is the optimum method for producing gas from water-saturated hydrate reservoirs. However, thermal stimulation is costly due to the heat generation from artificial systems.

The existing method for storing $CO_2$ in underground is to inject $CO_2$ into depleted oil/gas reservoirs or virgin aquifers. The $CO_2$ is trapped there in form of super-critical fluid under high pressure. This method is simple but is problematic in the long run. Recent studies show that the $CO_2$-exposed wells in $CO_2$ sequestration projects have high probabilities of leaking after certain years of service due to the $CO_2$ attack to defective wellbore cement sheath (Duguid et al., 2017; Guo, B. 2017). It is just a matter of time, sooner or later, when the stored high-pressure $CO_2$ will leak to the atmosphere through aged wellbores or leaky formation faults.

Consequently, there is need for new systems and methods for producing natural gas from hydrate deposits.

SUMMARY

Provided herein are systems and methods for producing natural gas from gas hydrate deposits and for storing carbon dioxide. In a specific embodiment, a system for producing natural gas from gas hydrate deposits includes: an injection well; a producing well; a producer annulus; a well annulus; a y-shaped well couple; a gas wellbore; a heating wellbore; a well tubing; a tank; a water pump; a separator; a wellhead choke; a work pipe; a $CO_2$ compressor; a well casing; and a pressure-regulator valve.

In another specific embodiment, a method for producing natural gas from gas hydrate deposits includes: obtaining hot water using ay-shaped horizontal well couple; injecting water heated by geothermal energy; transferring heat from a geothermal zone to a gas hydrate deposit zone using a dual-lateral horizontal well; regulating water-flooding flow rate using a wellhead choke; collecting water and natural gas using a dual-lateral horizontal well; and coupling the two horizontal wells through connection of two laterals in the gas hydrate zone.

In another specific embodiment, a method of injecting $CO_2$ through a natural geothermal zone to a natural gas reservoir includes: providing a tubing system comprising: an injection well; a producing well; a producer annulus; a well annulus; a y-shaped well couple; a gas wellbore; a heating wellbore; a well tubing; a tank; a water pump; a separator; a wellhead choke; a work pipe; a $CO_2$ compressor; a well casing; and a pressure-regulator valve; obtaining heat energy from a horizontal wellbore in a geothermal zone to heat $CO_2$; and transferring the heated $CO_2$ to a horizontal wellbore in a gas hydrate reservoir.

BRIEF DESCRIPTION OF THE DRAWINGS

For the purposes of promoting an understanding of the principles of the present disclosure, reference can be now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art can utilize their teachings. Therefore, no limitation of the scope of the present disclosure is thereby intended.

DETAILED DESCRIPTION

Figure 1:
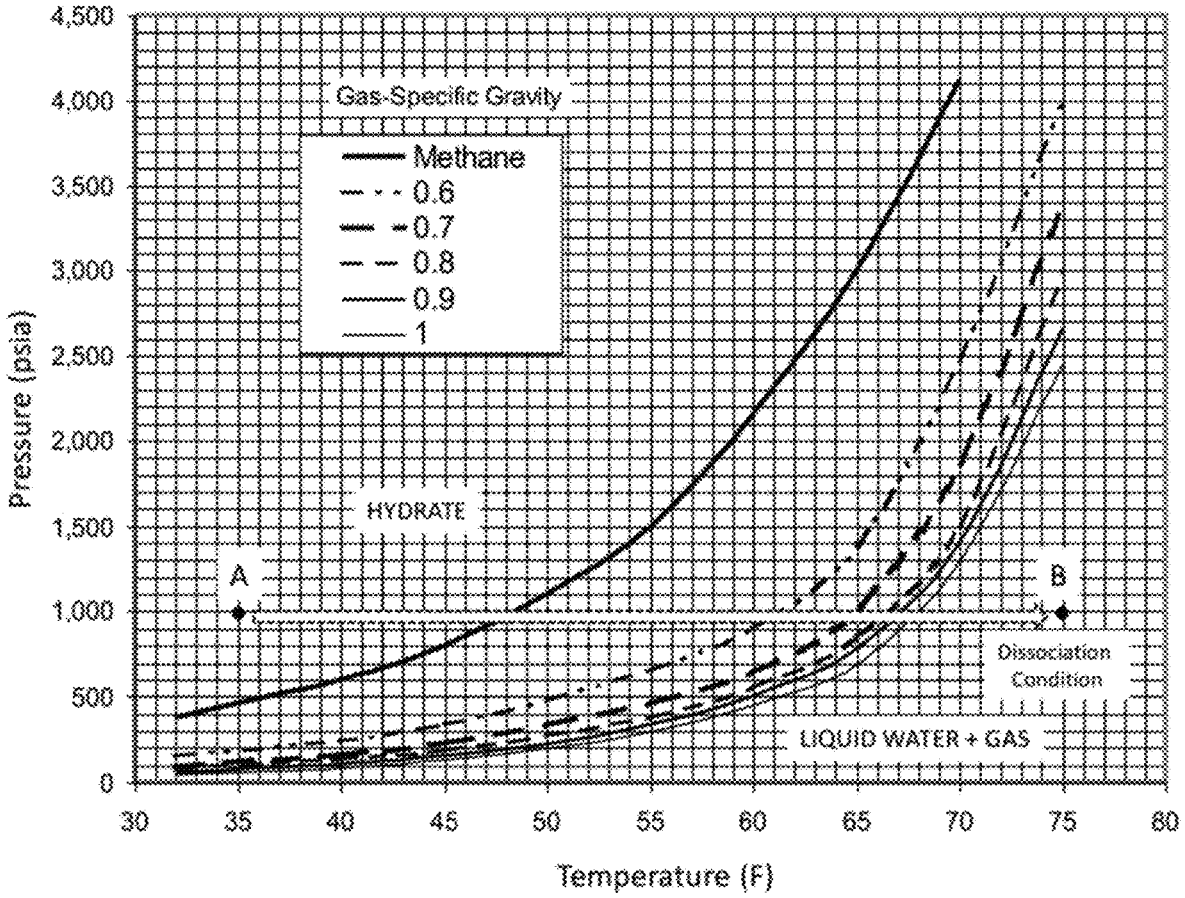
FIG. 1 is a phase diagram for hydrate-water-natural gas.

In one or more embodiments, the system and method for producing natural gas from gas hydrate deposits can include, but is not limited to: one or more injection wells; one or more producing wells; one or more injection wells; one or more gas wellbores; one or more producer annulus; one or more well annulus, one or more water collection wellbores, one or more heat absorber wellbores; one or more heat dissipator wellbore; one or more well tubings; one or more well casings; one or more water tanks; one or more water pumps; one or more y-shaped well couples; one or more gas-liquid separators; one or more wellhead chokes; one or more work pipes; one or more $CO_2$ compressors; one or more y-shaped well casing-tubing systems; one or more pressure-regulator valve, and combination thereof The system for producing natural gas and any of its components can be made from one or more suitable materials. For example, the one or more components of the systems for producing natural gas from gas hydrate deposits can made from any one or more metals (such as aluminum, steel, stainless steel, brass, nickel), metal alloys, concretes, fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as poly acrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halo butyl rubber and the like)), and mixtures, blends, or copolymers of any and all of the foregoing materials.

The various components of the system for producing natural gas can be attached to and/or integrally formed with each other to make the system. In some embodiments, the various components of the system for producing natural gas can be in fluid communication with one another and will the subterranean formation. In some embodiments, the components of the system for producing natural gas can include: one or more outer surfaces, one or more inner surfaces, one or more inner spaces, include a length, height, width, radius, first end, front side, second end, back side, right side, left side, top side, bottom side, outer surface, inner surface, and inner space.

In one or more embodiments, the method for producing natural gas from gas hydrate deposits can include, but is not limited to: injecting water into a wellbore placed in a geothermal aquifer below a gas hydrate reservoir; heating the water with the geothermal energy from the geothermal aquifer is led to a wellbore placed in the gas hydrate reservoir to water-flood and dissociate gas hydrates; a portion of the water cooled by the gas hydrate reservoir is circulated back to surface; the returned water is re-injected back into the water injection well; the natural gas released in the gas hydrate reservoir is produced through the annular space of a gas production well; and the produced natural gas is purified in a separator for sale. This method makes the full use of natural geothermal energy with minimal addition of electric energy that powers the water pump.

In some embodiments, the system and method for producing natural gas from gas hydrate deposits can bring geothermal energy to the gas hydrate deposit, heats the hydrate deposit, and causes dissociation of the gas hydrates, which facilitates gas production through a horizontal well couple. The systems and methods for producing natural gas from gas hydrate deposits can include producing natural gas from gas hydrates deposits embedded in onshore and/or offshore deposits.

In some embodiments, the system and method for producing natural gas from gas hydrates can provide effective and economical for large gas hydrate reservoirs to sustain long-term gas production. The systems and methods for producing natural gas from gas hydrates can provide safe collection of natural gas through the low-pressure system with minimalized risk of a gas leak. The systems and methods for producing natural gas from gas hydrates can be used with minimal supervision. Once the systems and methods are deployed, the users can monitor the pressure and temperature of the system and change the operational scheme accordingly. For example, the user can set the wellhead choke and add water to the water tank.

The natural gas hydrates can include crystalline water structures with low-molecular-weight guest molecules. The natural gas hydrates can also include. The presence of the gas molecules leads to stability of the crystalline structure. Natural gas hydrates can form a variety of crystal structures, depending primarily on the sizes of the guest molecules. They can include metastable minerals whose formation, stability, and decomposition depend on pressure, temperature, composition, and other properties of the gas and water. The hydrates can include nitrogen, carbon dioxide, methane, ethane, propane, iso-butane, n-butane, and some branched or cyclic C5-C8 hydrocarbons. FIG. 1 shows a simple phase diagram of the method of the invention invoking dissociation of gas hydrates. Equilibrium curves are based on data from the public domain. Dissociation of gas hydrates from solid hydrate to liquid water and gas is affected by the increased temperature under isobar conditions. The dissociation temperature and pressure are indicated at point B.

Figure 2:
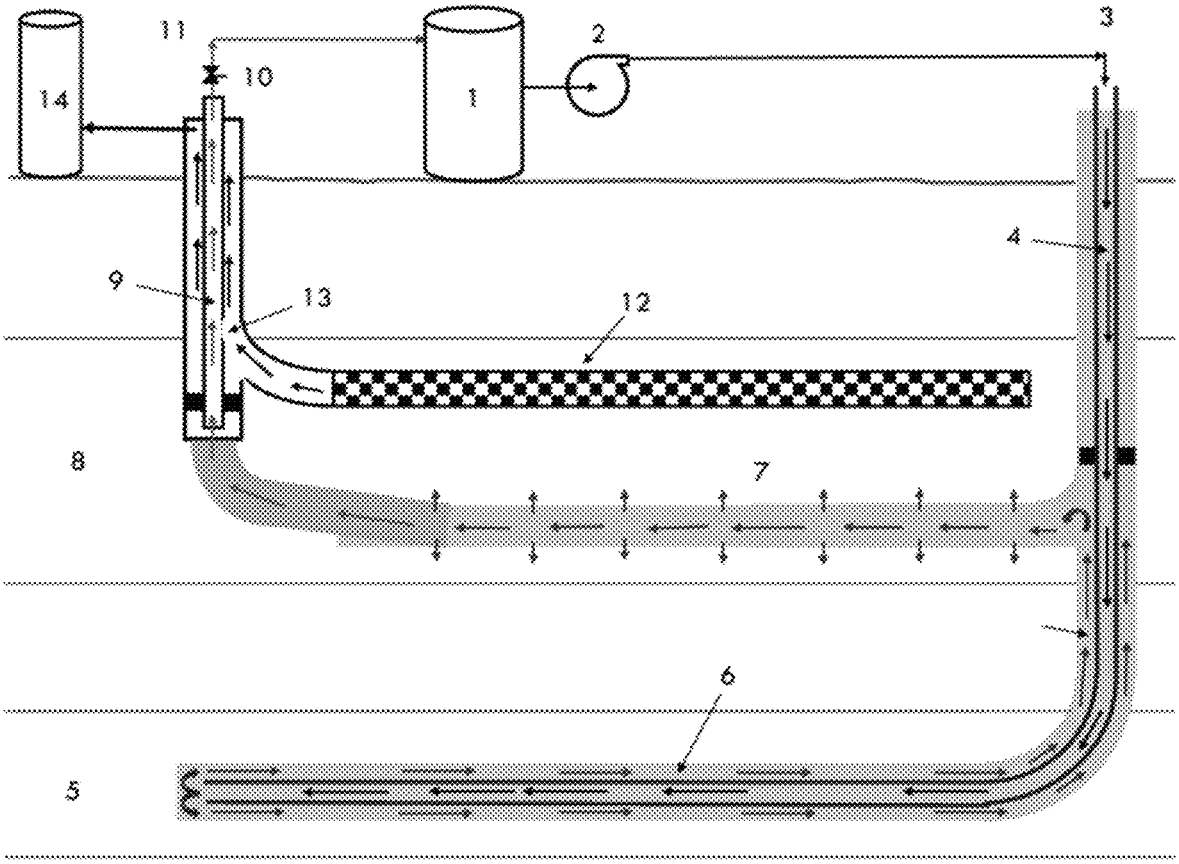
FIG. 2 shows an embodiment of a system for producing natural gas from gas hydrate deposits by water flooding.

FIG. 2 shows an embodiment of a system and method for producing natural gas from gas hydrates deposits. In the embodiment, water in water tank 1 is injected by pump 2 into the water injection well 3 along the work pipe 4 reaching the geothermal zone 5. The water in the injection wellbore annulus 6 is heated by the geothermal zone. The hot water travels along the well annulus and arrives at the heating wellbore 7 in the gas hydrate zone 8. The heat energy in the hot water dissipates into the gas hydrate zone by heat convection through wellbore perforations and heat conduction through wellbore casing and cement sheath. At least a portion of water stream enters the well tubing 9, flows through wellhead choke 10 of the gas producing well 11. The wellhead choke 10 can be used for regulating water flow rate into the gas hydrate zone. The dissociated gas in the gas hydrate zone enters gas wellbore 12, flows along the producer annulus 13, and arrives at separator 14 for phase separation and sale.

In some embodiments, the system and method for producing natural gas from gas hydrate deposits can utilize geothermal energy through ay-shaped wellbore couple to facilitate the production of natural gas from gas hydrate reservoirs, which can reduce or eliminate the need to burn fossil fuels or use electricity to heat the injection water, thereby reducing the carbon footprint. In some embodiments, the wellhead choke can regulate water-flooding flow rate.

The systems and methods for producing natural gas from gas hydrate deposits can use natural geothermal energy to facilitate the dissociation of natural gas and greatly reduces the energy consumed for gas production. The source of heat is the key to the technical and economic feasibility as well as to the long-term sustainability of gas production. The replacement of artificial energy with natural energy not only greatly reduces the operational cost to heat the water but also entails minimal operational complexity once the system is deployed. The combination of the geothermal technique along with the established mathematical model also allows for a ranged evaluation of alternative scenarios that would be intangible to investigate otherwise.

The systems and methods for producing natural gas from gas hydrate deposits can provide quantitative optimization and design for the selection of the properties of the circulating water and cement/insulation for each section of the wellbores for a higher heat transfer performance. In some embodiments, the system and method for producing natural gas from gas hydrate deposits the wells are completed according to the design of configurations; the water is injected by the pump through the work pipe of the injection wellbore; the water is heated by the heat absorber horizontal wellbore; the heated water flows back through the injection annulus and enters the heat dissipator wellbore and floods the gas hydrate deposit; the remaining water flows through the tubing of the production wellbore and gets collected by the water tank; the natural gas released from the gas hydrates enters the gas production wellbore, flows up the annulus of the gas well, and arrives at separator for sale. The method can heat the water to the in-situ temperature of the geothermal zone and create a temperature difference of over 30° C. (54° F.) at the gas hydrate zone.

The systems and methods for producing natural gas from gas hydrate deposits can utilize natural energy instead of commercial energy supplies to facilitate gas production, which can significantly minimize the environmental footprint. The systems and methods for producing natural gas from gas hydrate deposits can be an ecologically and geologically friendly process. In some embodiments, the system and method for producing natural gas from gas hydrate deposits can allow for the production of natural gas without a significant pressure drop in the gas hydrate deposits, which greatly reduces the risk of tectonic movement associated with depleted reservoirs.

The systems and methods for injecting carbon dioxide into methane hydrate reservoirs geothermal method uses the natural geothermal energy from a zone below the gas hydrate reservoir for accelerating the dissociation of gas hydrates, and, yet still does not hinder the formation of $CO_2$ hydrates. These systems and methods can be feasible if the temperature of the gas hydrate reservoir is maintained above the methane-hydrae dissociation temperature and below the $CO_2$-hydrate formation temperature at a desired level of gas production pressure. This range of reservoir temperature is achievable using the y-shaped well couples in the systems for injecting carbon dioxide into methane hydrate reservoirs. The risk that the solid hydrate structure will dissociate, and huge amount of water will be discharged with the produced gas can be solved by methane-$CO_2$ hydrate exchange in low-temperature reservoirs.

The systems and methods for injecting carbon dioxide into methane hydrate reservoirs takes the advantage of the naturally cold environment in gas hydrate reservoirs to store $CO_2$ in solid state ($CO_2$-hydrates) so that high-pressure condition is avoided to prevent $CO_2$ leak into atmosphere. In some embodiments, the method for injecting carbon dioxide into methane hydrate reservoirs can include, but is not limited to: placing $CO_2$ in solid form in natural gas hydrate reservoirs, dissociating the methane hydrates; forming $CO_2$ hydrates; displacing the methane by the $CO_2$ hydrates, and storing the $CO_2$ in a reservoir. In some embodiments, the method can include, but is not limited to: completing wells according to the design of configurations; injecting $CO_2$ using a compressor through the work pipe of the injection wellbore; heating the $CO_2$ by the heat absorber horizontal wellbore, where the heated $CO_2$ flows back through the injection annulus and enters the heat dissipator wellbore; at least partially flooding the gas hydrate deposit with $CO_2$, where the remaining $CO_2$ flows through the tubing of the production wellbore and gets collected by the $CO_2$ tank for recycling injection; releasing the natural gas from the gas hydrates, where the gas enters the production wellbore, where the gas flows up the annulus of the gas well, and arrives at separator for sale. In some embodiments, the method can include heating the $CO_2$ to the in-situ temperature between the forming temperatures of methane hydrate and $CO_2$ hydrate.

Figure 3:
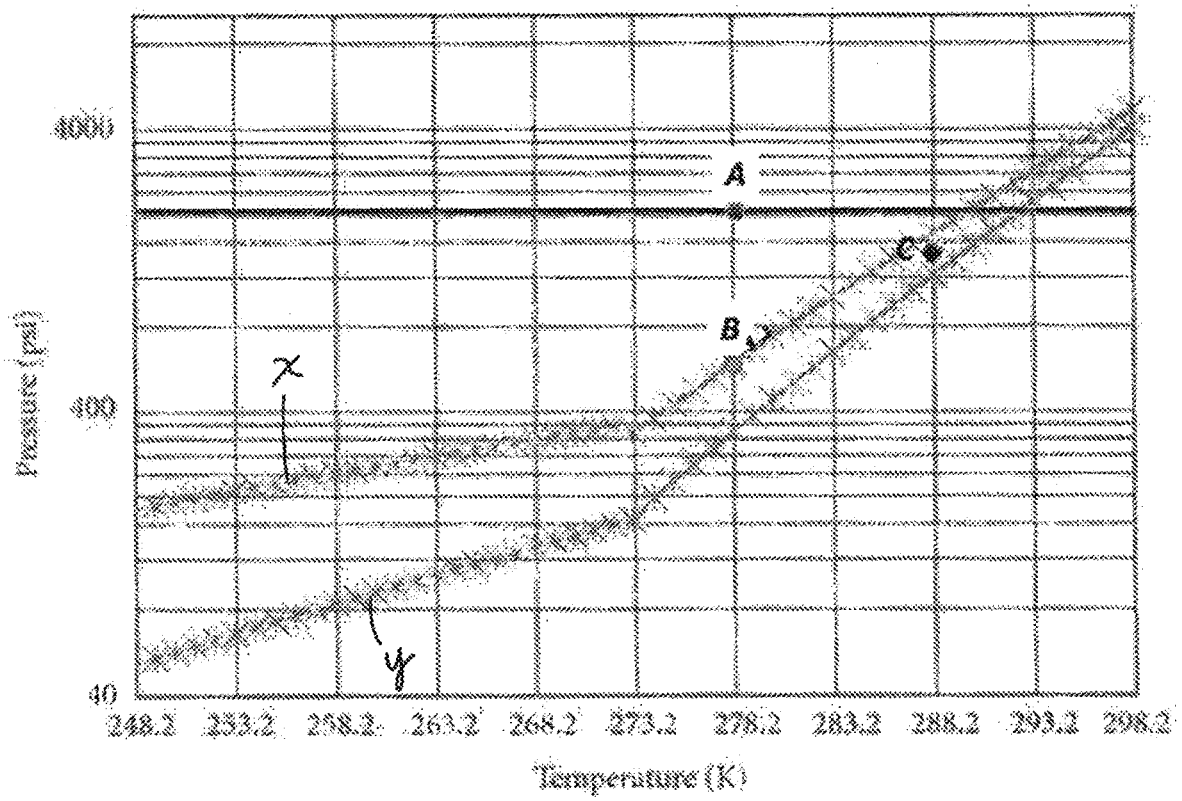
FIG. 3 is a phase diagram for hydrate-water-methane and $CO_2$.

FIG. 3 shows a phase diagram for the dissociation of methane hydrates and formation of $CO_2$ hydrates. Equilibrium curves are based on data from Sloan and Koh; the equilibrium curve labeled "x" on FIG. 3 represents methane-hydrate disassociation pressure plotted against temperature, while the equilibrium curve labeled "y" on FIG. 3 represents $CO_2$ hydrate formation pressure plotted against temperature. Point A on FIG. 3 represents the initial condition (pressure and temperature) of a gas reservoir. Point B on FIG. 3 depicts methane hydrate dissociation pressure utilizing a conventional depressurization method of gas production from gas hydrates. Point Con FIG. 3 denotes the operating point of natural gas production from gas hydrates in accordance with the method of the present method. The temperature increase associated with Point C on FIG. 3 is induced by injected $CO_2$ which is heated by geothermal energy. Maintaining the condition defined by the operating Point C depicted in FIG. 3 allows for dissociation of methane hydrates and formation of $CO_2$ hydrates.

The methods and systems for injecting carbon dioxide into methane hydrate reservoirs uses the natural geothermal energy from a zone below the gas hydrate reservoir for accelerating the dissociation of gas hydrates and yet still does not hinder the formation of $CO_2$ hydrates. These methods and systems are feasible if the temperature of the gas hydrate reservoir is maintained above the methane-hydrae dissociation temperature and below the $CO_2$-hydrate formation temperature at a desired level of gas production pressure. This range of reservoir temperature is achievable using the y-shaped well couples.

The methods and systems for injecting carbon dioxide into methane hydrate reservoirs can provide quantitative optimization and design for the selections of $CO_2$ injection rate and insulations of pipe and cement for each section of the wellbores to ensure high efficiency of heat transfer. The methods and systems for injecting carbon dioxide into methane hydrate reservoirs utilize geothermal energy through a y-shaped wellbore couple to facilitate the dissociation of gas hydrates, formation and deposition of $CO_2$ hydrates, and production of natural gas from gas hydrate reservoirs, which eliminates the need to burn fossil fuels or use electricity to heat the injection $CO_2$ and greatly reduces the carbon footprint. An advantage of this technique is that it is a process that allows $CO_2$ be stored in low-temperature environment at low pressure. This condition ensures that the $CO_2$ is firmly stored in solid form without being leaked to the atmosphere. Another advantage of this technique is that it is an ecologically and geologically friendly process. The technique does not cause significant pressure drop in the gas hydrate deposit, which greatly reduces the risk of tectonic movement associated with depleted gas hydrate reservoirs. Yet another advantage of the technique is that it requires minimal supervision. Once the system is deployed, the onsite engineers only need to monitor the pressure and temperature of the system and automatically change the operational scheme accordingly through setting of wellhead choke and feeding the $CO_2$ tank with make-up $CO_2$. Still another advantage of the technique is that it is especially effective and economical for large gas hydrate reservoirs to store $CO_2$ and sustain long-term gas production.

Figure 4:
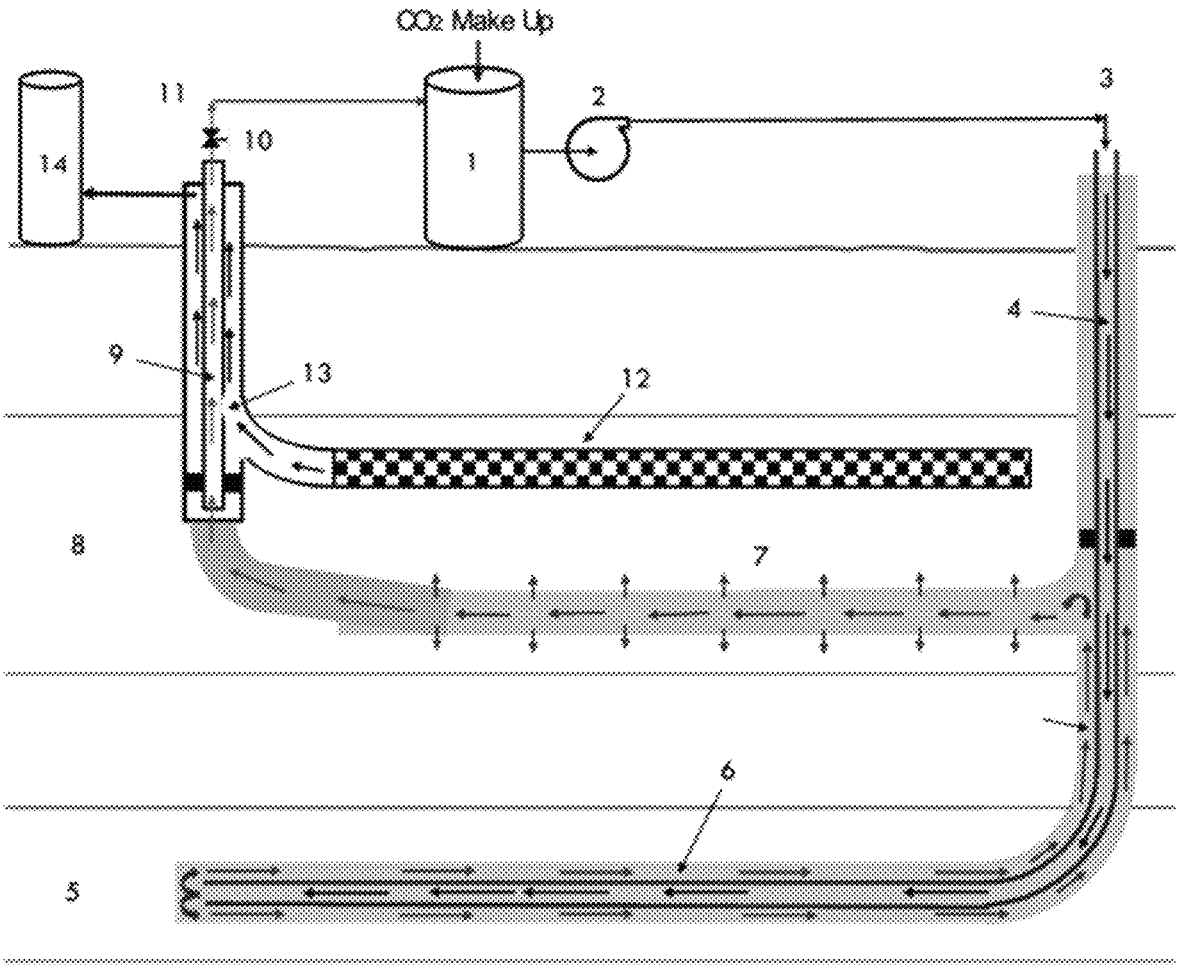
FIG. 4 shows an embodiment of a system for producing natural gas from gas hydrate deposits, which can also provide for $CO_2$ sequestration.

FIG. 4 shows an embodiment of a system for injecting carbon dioxide into methane hydrate reservoirs. In the embodiment, a y-shaped well couple for heat transfer from a geothermal zone to a gas hydrate reservoir. The $CO_2$ from the $CO_2$ tank 1 is compressed by $CO_2$ compressor 2 and transferred to the $CO_2$ injection well 3 where the $CO_2$ is injected through injection pipe 4 down to a horizontal hole in a geothermal zone 5. The $CO_2$ is heated in the heat-receiving hole 6 by the geothermal energy. The heated $CO_2$ is lead to a heat-releasing horizontal hole 7 where a fraction of the $CO_2$ stream is injected into the gas hydrate reservoir 8 for dissociating methane-hydrates. At least a portion of the $CO_2$ stream returns to surface through well tubing 9. The wellhead choke 10 at the gas production well 11 controls back pressure for adjusting the amount of $CO_2$ returning to the $CO_2$ tank 1 for re-circulation. The amount of $CO_2$ injected to the hydrate reservoir is made up from a $CO_2$ supply line. The horizontal gas wellbore 12 collects methane gas at a pressure that is below the methane-hydrate dissociation pressure and above the $CO_2$-hydrate formation pressure at the in-situ temperature. The collected gas is transported through well tubing string 13 and delivered to separator 14. Only minimal amount of energy is supplied to the system for power the $CO_2$ compressor. The system allows to inject $CO_2$ to bring geothermal energy to the methane hydrate reservoir, dissociate the methane hydrates, form $CO_2$ hydrates, displace the methane by the $CO_2$ hydrates, and permanently store the $CO_2$ in the reservoir.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

One of ordinary skill in the art will readily appreciate that alternative, but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. It should also be appreciated that the numerical limits may be the values from the examples. Certain lower limits, upper limits and ranges appear in at least one claim below. All numerical values are "about" or "approximately" the indicated value, and take into account experimental error and variations that would be expected by a person having ordinary skill in the art.

REFERENCES

1. Allison, E. 2008. Methane Hydrates in Future Energy: Improved, Sustainable and Clean Options for our Planet, ed. by T. M. Letcher (Elsevier).
2. Kvamme, B., Graue, A., Buanes, T., Kuznetsova, T., and Ersland, G. 2009. Effects of solid surfaces on hydrate kinetics and stability, Geological Society, London, Special Publications 319 (2009) 131-144. doi:10.1144/SP319.11.
3. Sloan, E. D. and Koh, C. A. 2008. Clathrate Hydrates of Natural Gases. CRC Press, Boca Raton, Fla, USA, 2008.
4. Ohgaki, K., Takano, K., Sangawa, H., Matsubara, T., and Nakano, S. 1996. Methane Exploitation by Carbon Dioxide from Gas Hydrates-Phase Equilibria for $CO_2$—$CH_4$ Mixed Hydrate System. Journal of Chemical Engineering of Japan, Vol. 29, no. 3, pp. 478-483.
5. Goel, N. 2006. In situ methane hydrate dissociation with carbon dioxide sequestration: current knowledge and issues. Journal of Petroleum Science and Engineering, vol. 51, no. 3-4, pp. 169-184, 2006.
6. Nago, A. and Nieto, A. 2011. Natural Gas Production from Methane Hydrate Deposits Using $CO_2$ Clathrate Sequestration: State-of-the-Art Review and New Technical Approaches. Journal of Geological Research Volume 2011, Article ID 239397. doi:10.1155/2011/239397.
7. Zheng, J., Chong, Z. Qureshi, M. F., and Linga, P. 2020. Carbon Dioxide Sequestration via Gas Hydrates: A Potential Pathway toward Decarbonization *Energy Fuels* 2020, 34, 9, 10529-10546. https://doi.org/10.1021/acs.energyfuels.0c 02309.
8. Kvamme, B., Graue, A., Buanes, T., Kuznetsova, T., and Ersland, G. 2007. Storage of CO2 in natural gas hydrate reservoirs and the effect of hydrate as an extra sealing in cold aquifers, Int. J. Greenh. Gas Control 1 (2007) 236-246. doi:10.1016/S1750-5836(06)00002-8.
9. Graue, A., Kvamme, B., Baldwin, B., Stevens, J., Howard, J. J., Aspenes, E., Ersland, G., Husebo, J., and Zornes, D. 2008. MRI Visualization of Spontaneous Methane Production from Hydrates in Sandstone Core Plugs When Exposed to CO2, SPE Journal 13 (2008) 146-152. doi: 10.2118/118851-PA.
10. Ersland, G., Husebo, J., Graue, A., and Kvamme, B. 2009. Transport and storage of CO2 in natural gas hydrate reservoirs, Energy Procedia 1 (2009) 3477-3484. doi: 10.1016/j.egypro. 2009.02.139.
11. Kvamme, B., Qasim, M., Baig, K., Kivela, P.-H., and Bauman, J. 2014. Hydrate phase transition kinetics from Phase Field Theory with implicit hydrodynamics and heat transport, Int. J. Greenh. Gas Control 29 (2014) 263-278. doi:10.1016/j.ijggc.2014.08.003.
12. Koh, D.-Y., Kang, H., Lee, J.-W., Park, Y., Kim, S.-J., Lee, J., Lee, J. Y., Lee, H., 2016. Energy efficient natural gas hydrate production using gas exchange. Applied Energy 162, 114-130.
13. Qorbania, K., Kvammea, B., Kuznetsovaa, T. 2016. Simulation of CO2 Storage into Methane Hydrate Reservoirs, Non-equilibrium thermodynamic Approach. Paper GHGT-13 presented at the 13th International Conference on Greenhouse Gas Control Technologies held in Lausanne, Switzerland, 14-18 Nov. 2016.
14. Jadhawar, P., Yang, J., Chapoy, A. and Tohidi, B. 2021. Subsurface Carbon Dioxide Sequestration and Storage in Methane Hydrate Reservoirs Combined with Clean Methane Energy Recovery. *Energy Fuels,* 2021, 35, 2, 1567-1579. https://doi.org/10.1021/acs.energyfuels.0c02839.
15. Dickens G R, Quinby-Hunt M S. 1994. Methane hydrate stability in seawater. Geophysical Research Letters, 21(19), 2115-2118.
16. Wang, Y., Feng, J., Li, X., Zhang, Y. and Li, G. 2015. Analytic modeling and large-scale experimental study of mass and heat transfer during hydrate dissociation in sediment with different dissociation methods. Energy, xxx. 118.
17. Wang, Y., Feng, J., Li, X., and Zhang, Y. 2016. Experimental and modeling analyses of scaling criteria for methane hydrate dissociation in sediment by depressurization. Applied Energy, 181, 299-309.
18. Wang, Y., Feng, J., Li, X., Zhang, Y. and Chen, Z. 2018. Fluid flow mechanisms and heat transfer characteristics of gas recovery from gas-saturated and water-saturated hydrate reservoirs. International Journal of Heat and Mass Transfer. 118, 1115-1127.
19. Duguid, A., Guo, B., Nygaard, R., 2017. Well integrity assessment of monitoring wells at an active CO2-EOR flood. Energy Proc. 114 (November 2016), 5118-5138. https://doi.org/10.1016/j.egypro.2017.03.1667.
20. Guo, B. 2017. Statistical Analysis of CO2 Exposed Wells to Predict Long Term Leakage through the Development of an Integrated Neural-Genetic Algorithm. Report to U.S. DOE for project DE FE0009284. University of Louisiana at Lafayette. Lafayette, Louisiana (May 10, 2017).
21. Abdalla B. K., Abdullatef, N. A. Simulation and economic evaluation of natural gas hydrates [NGH] as an alternative to liquefied natural gas [LNG]. Catalysis Today, 2005, 106(1-4): 256-258.

22. Byk S. S., Fomina V. I. Gas hydrates. Russian Chemical Reviews, 1968, 37(6): 469.
23. Boswell, R., 2007. Resource potential of methane hydrate coming into focus, JPSE, 56, 9-13. Carson, D. B. and Katz, D. L. 1942. "Natural Gas Hydrates," Trans. AIME, Vol. 146, 150-159.
24. Dickens G. R., Quinby-Hunt M. S. Methane hydrate stability in seawater. Geophysical Research Letters, 1994, 21(19): 2115-2118.
25. Demirbas A., Methane hydrates as potential energy resource: Part 1-Importance, resource and recovery facilities. Energy Conversion and Management, 2010a, 51(7): 1547-1561.
26. Demirbas A., Methane hydrates as potential energy resource: Part 2-Methane production processes from gas hydrates. Energy Conversion and Management, 2010b, 51(7): 1562-1571.
27. Guo B., Fu C., Liu N., A priori assessment of long-term productivity of frac-packed wells for producing natural gas from marine gas hydrate reservoirs. Energy Science & Engineering, 2021.
28. Guo, B., Li, J., Song, J. and Li, G., Mathematical modeling of heat transfer in counter-current multiphase flow found in gas-drilling systems with formation fluid influx, Journal of Petroleum Science (May 2017). DOI 10.1007/si2182-017-0164-3.
29. Gaydukova O. S., Misyura S. Y., Strizhak P. A. Investigating regularities of gas hydrate ignition on a heated surface: Experiments and modelling. Combustion and Flame, 2021, 228: 78-88.
30. Gas Processors Suppliers Association. Engineering Data Book, 9th ed., 3rd revision, 1977.
31. Hong, H., and Pooladi-Darvish, M., 2005. Simulation of Depressurization for Gas Production from Gas Hydrate Reservoirs, J. Can. Pet. Tech., 44 (11), 39-46.
32. Kvenvolden, K. A., 1988. Methane hydrate—a major reservoir of carbon in the shallow geosphere, Chem. Geol. 71, 41-51.
33. Klauda, J. B., Sandler, S. I., 2005. Global distribution of methane hydrate in ocean sediment, Energy & Fuels 19, 469.
34. Konno Y, Fujii T, Sato A., et al. Influence of Flow Properties on Gas Productivity in Gas-Hydrate Reservoirs: What Can We Learn from Offshore Production Tests? Energy & Fuels, 2021, 35(10): 8733-8741.
35. Kurihara, M., K. Funatsu, H. Ouchi, Y. Masuda and H. Narita, 2005. "Investigation On Applicability of Methane Hydrate Production Methods To Reservoirs With Diverse Characteristics", Paper 3003 presented at the 5th International Conference on Gas Hydrates, Trondheim, Norway, 13-16 June, Proceedings, Vol. 3, 714-725.
36. Li, J., Guo, B., Li, B., 2015, A closed form mathematical model for predicting gas temperature in gas-drilling unconventional tight reservoirs, Journal of Natural Gas Science and Engineering, 27, 284-289.
37. Makogon, Y. F., 1997. Hydrates of Hydrocarbons. Penn Well Publishing Co. Tulsa, OK.
38. Milkov, A. V., 2004. Global estimates of hydrate-bound gas in marine sediments: How much is really out there? Earth Science Reviews 66(3), 183.
39. Moridis G J, Collett T S, Boswell R, et al. Toward production from gas hydrates: assessment of resources, technology and potential. SPE unconventional reservoirs conference. OnePetro, 2008.
40. Moridis, G. J., and Reagan, M. T. 2007a. Strategies for Gas Production From Oceanic Class 3 Hydrate Accumulations, OTC-18865, 2007 Offshore Technology Conference, Houston, Texas, 30 April-3 May 2007.
41. Moridis, G. J., Reagan, M. T., 2007b. Gas Production From Oceanic Class 2 Hydrate Accumulations, OTC 18866, 2007 Offshore Technology Conference, Houston, Texas, U.S.A., 30 April-3 May 2007.
42. Moridis, G. J., T. Collett, S. Dallimore, T. Satoh, S. Hancock and B. Weatherhill, 2004. Numerical Studies of Gas Production From Several Methane Hydrate Zones At The Mallik Site, Mackenzie Delta, Canada, JPSE 43, 219.
43. Moridis, G. J., T. S. Collett, S. R. Dallimore, T. Inoue and T. Mroz, 2005. Analysis and Interpretation of the Thermal Test of Gas Hydrate Dissociation in the JAPEX/JNOC/GSC et al. Mallik 5L-38 Gas Hydrate Production Research Well, in Scientific Results from the Mallik 2002 Gas Hydrate Production Research Well Program, Mackenzie Delta, Northwest Territories, Canada. Geological Survey of Canada, Bulletin 585, S. R. Dallimore and T. Collett, Eds.
44. Peng C., Zou C., Lu Z., Characteristics of gas hydrate reservoirs and their effect on petrophysical properties in the Muli area, Qinghai-Tibetan plateau permafrost. Journal of Natural Gas Science and Engineering, 2018, 57: 266-283.
45. Paull, C., Ussler, W., Lorenson, T., Winters, W., and J. Dougherty, 2005, Geochemical constraints on the distribution of gas hydrates in the Gulf of Mexico: Geo-Marine Letters, 25; DOI: 10.1007/s00367-005-0001-3.
46. Qin X., Liang Q., Ye J., et al. The response of temperature and pressure of hydrate reservoirs in the first gas hydrate production test in South China Sea. Applied Energy, 2020, 278: 115649.
47. Reagan M. T., Moridis G. J., Elliott S. M., et al. Contribution of oceanic gas hydrate dissociation to the formation of Arctic Ocean methane plumes. Journal of Geophysical Research: Oceans, 2011, 116(C9).
48. Ruppel, C., Dickens, G., Castellini, D., Gilhooly, W., and D. Lizzarralde, 2005, Heat and salt inhibition of gas hydrate formation in the northern Gulf of Mexico: Geophysical Research Letters, 32(4), L04605, DOI: 10.1029/2004GL021909.
49. Shoghl S. N., Nazerifard R., Naderifar A., Improvement of recovery of gaseous fluids using the replacement of supersonic separator instead of Joule-Thomson valve in dehydration/NGL recovery unit with computational fluid dynamic modeling. Chemical Engineering Research and Design, 2019, 148: 1-10.
50. Uchida T, Tsuji T. Petrophysical Properties of Natural Gas Hydrates-Bearing Sands and Their Sedimentology in the Nankai Trough. Resource Geology, 2004, 54(1): 79-87.
51. U.S. Geological Survey Fact Sheet 021-01 https://pubs.usgs.gov/fs/fs021-01/fs021-01.pdf Wang, X. (2009). CHAPTER 4—Natural Gas Processing. Page 158.

What is claimed is:

1. A method for producing natural gas from gas hydrate deposits, the method comprising:

a) providing an injection wellbore comprising a vertical section and a horizontal section, wherein said horizontal section of said injection wellbore at least partially extends into a subterranean geothermal zone;

b) providing an injection tubing string in said injection wellbore, wherein said injection tubing string has an inner through bore and defines an annular space along an outer surface of said injection tubing string, and wherein said annular space of said injection wellbore is in fluid communication with a subterranean gas hydrate zone;

c) providing a production wellbore comprising a vertical section and a horizontal section, wherein said horizontal section of said production wellbore at least partially extends into said subterranean gas hydrate zone;

d) providing a production tubing string in said vertical section of said production wellbore, wherein said production tubing string has an inner through bore and defines an annular space along an outer surface of said production tubing string, wherein said inner through bore of said production tubing string and said annular space of said production wellbore are isolated from each other;

e) pumping water through the inner through bore of said injection tubing string of said injection wellbore and into said annular space of said injection wellbore;

f) heating said water in said annular space of said injection wellbore using heat energy from said geothermal zone;

g) injecting said heated water from said annular space of said injection wellbore into said subterranean gas hydrate zone;

h) producing natural gas from said subterranean gas hydrate zone through said horizontal section and said annular space of said production wellbore;

i) recovering injected water from said subterranean gas hydrate zone through said inner through bore of said production tubing string; and j) regulating flow rate of said recovered water using a wellhead choke.

* * * * *